United States Patent [19]

Angas

[11] Patent Number: 4,677,698

[45] Date of Patent: Jul. 7, 1987

[54] HOCKEY GLOVE HAVING A FLEXIBLE CUFF

[75] Inventor: David J. Angas, Milton, Canada

[73] Assignee: Karhu Titan Canada Limitee, Canada

[21] Appl. No.: 873,412

[22] Filed: Jun. 12, 1986

[30] Foreign Application Priority Data

Jan. 22, 1986 [CA] Canada ..... 500094

[51] Int. Cl.[4] ..... A41D 13/08

[52] U.S. Cl. ..... 2/161 A; 2/16; 2/19

[58] Field of Search ..... 2/161 A, 161 R, 162, 2/16, 18, 19, 20

[56] References Cited

U.S. PATENT DOCUMENTS

| | | | |
|---|---|---|---|
| 3,605,117 | 1/1970 | Latina | 2/16 |
| 3,626,515 | 12/1971 | Murray | 2/161 A |
| 4,027,339 | 6/1977 | Brucker | 2/16 |
| 4,137,572 | 2/1979 | Jansson et al. | 2/16 |
| 4,411,024 | 10/1983 | Hayes | 2/161 A X |
| 4,484,359 | 11/1984 | Tirinen | 2/161 A X |
| 4,497,073 | 2/1985 | Deutsch | 2/161 A |
| 4,541,127 | 9/1985 | Gould | 2/19 |

*Primary Examiner*—Werner H. Schroeder
*Assistant Examiner*—J. L. Olds
*Attorney, Agent, or Firm*—Joseph G. Seeber

[57] ABSTRACT

The invention relates to hockey gloves having means to improve wrist movements. Such hockey gloves include a cushioned cuff portion having an opening in the side opposite the thumb defining an upper edge and a lower edge. A triangular shaped segment is defined by one such edge, the end of the glove and a seam joining such end and edge. The cushioned cuff portion can also be provided with a second triangular shaped segment on the opposite edge. The seam acts as a hinge.

9 Claims, 7 Drawing Figures

HOCKEY GLOVE HAVING A FLEXIBLE CUFF

FIELD OF THE INVENTION

This invention relates to hockey gloves and more particularly, to improved hockey gloves with means to improve wrist movements.

BACKGROUND OF THE INVENTION

Hockey gloves are well known. Hockey gloves form part of the protective equipment which those who participate in the sport of hockey must wear in order to prevent serious injuries to vulnerable portions of the body. Indeed, the hands and wrists are particularly vulnerable in that they can be hit by the puck or opposing players' hockey sticks and skates and can be scraped or rammed against the ice, side boards or the nets. For this reason, hockey gloves possess considerable padding across the back of the fingers and thumb as well as across the back of the hand proper. A padded cuff portion is also provided to protect the wrist. Typically, the cuff is opened on the side of the hand opposite the thumb. The width of this opening is adjustable according to the requirements of the player by the use of lacing which extends in eyelets provided along each side of the cuff opening. See for example U.S. Pat. No. 3,605,177 (Latina).

However, such hockey gloves are discomfortable because of the rigidity of the cuff portion which restricts the movements of the wrist. Some hockey players are even removing the lacing and cutting away part of the protective material in the cuff portion to increase the freedom of the wrist movements for better control of the hockey stick, albeit to the detriment of protection.

U.S. Pat. No. 4,497,073 (Deutch) discloses a lacrosse glove comprising: a padded hand receiving portion; a cushioned cuff portion which is secured on said hand receiving portion by a flexible connecting means positioned in the opening between hand portion and the cuff portion, on the side of the glove above the thumb. Although a lacrosse glove is, in many respects similar to a hockey glove, the former is not used to play hockey because the protection afforded in the wrist portion is not adequate for the game of hockey.

OBJECT OF THE INVENTION

It is an object of the present invention to provide a hockey glove which allows for improved hand movements.

It is a further object of the present invention to provide such improved hand movements without any marked reduction in the protection afforded by the cuff portion of the glove.

It is still a further object of the present invention to provide such improved hand movements while minimizing the number of seams in the cuff area, thus maintaining better protection.

BRIEF DESCRIPTION OF THE INVENTION

Therefore, hockey gloves according to the present invention include a cushion cuff portion having a longitudinal opening located on the side opposite the thumb, the opening defining an upper edge and a lower edge. The cuff portion is provided with a triangular-shaped segment adjacent one of the edges and preferably with two triangular-shaped segments located respectively adjacent each of the edges.

These triangular segments are defined by their respective edge, by the end of the cuff distal from the finger portion of the glove, and by a seam extending angularly from the edge towards the distal end of the cuff.

DESCRIPTION OF A PREFERRED EMBODIMENT

Figures 1, 2, 3:
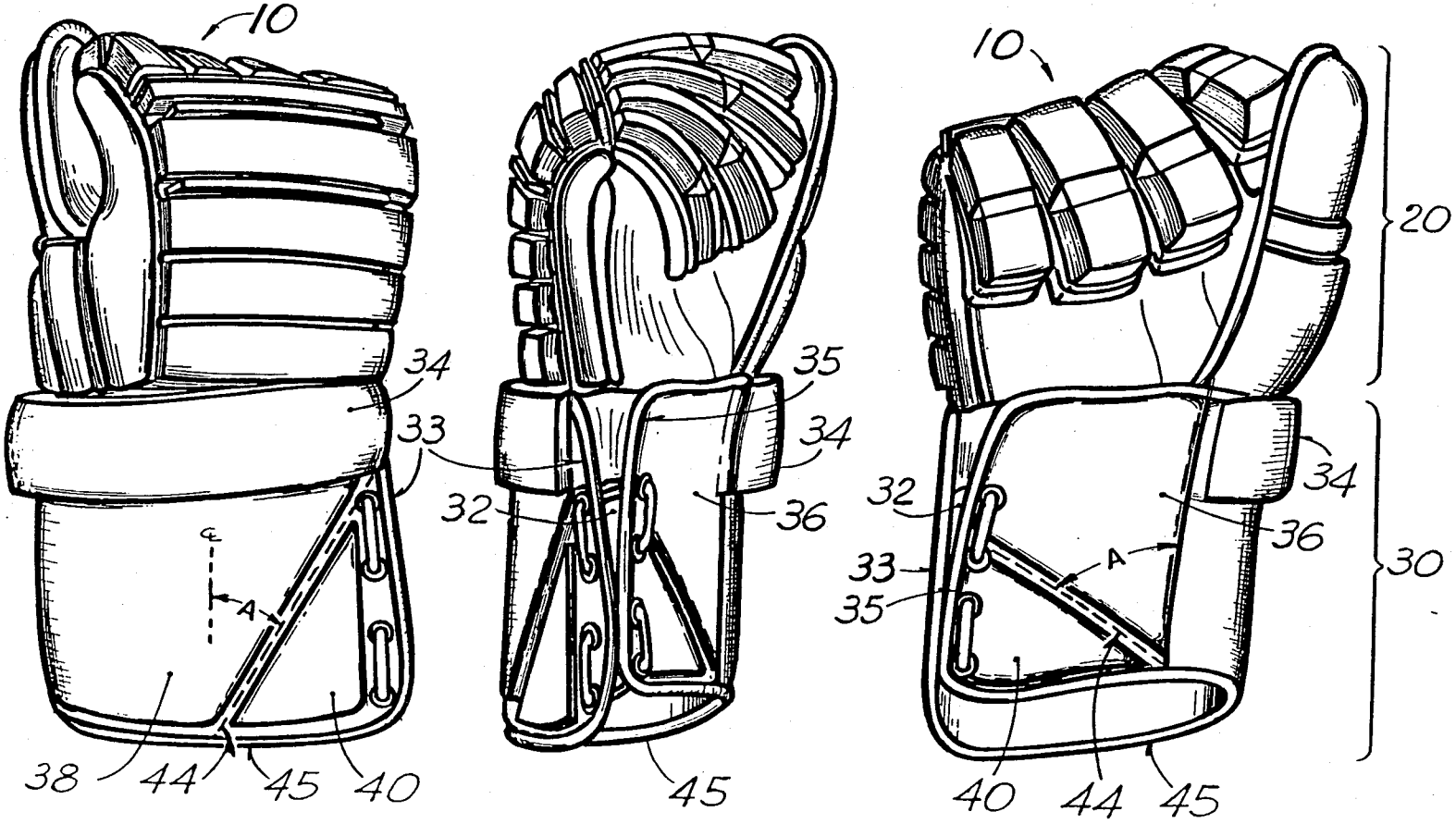
FIG. 1 is a plan view of the upper of a left hand embodiment of the invention.
FIG. 2 is a side view of the embodiment shown in FIG. 1.
FIG. 3 is a plan view of the inside of the embodiment shown in FIG. 1.

Referring to the drawings, numeral 10 indicates a hockey glove having a hand portion 20 and a cuff portion 30.

The hand portion 20 is constructed in a manner well know to those skilled in the art.

The cuff portion 30 comprises a large padding roll 34, an upper padding 38, a lower padding 36 and a laced opening 32 defining upper edge 33 and lower edge 35.

Triangular segments 40 are defined by edge 33 or edge 35, seam 44 and the end 45 of cuff portion 30 which is distal from the hand portion 20.

Seam 44 thus defines a hinge which extends longitudinally outwardly from the end of edges 33 and 35 which is closest to hand portion 20 following an angle A relative to the centerline of the glove opening 32.

However, it will be appreciated that angle A may be more or less open without departing from the basic concept of the improved hockey glove. It will be seen that a small angle provides more flexibility while a wide angle provides less flexibility.

Similarly, a single triangular segment may be used without departing from the invention. Generally the single segment is located in the lower padding 36.

Figure 4:
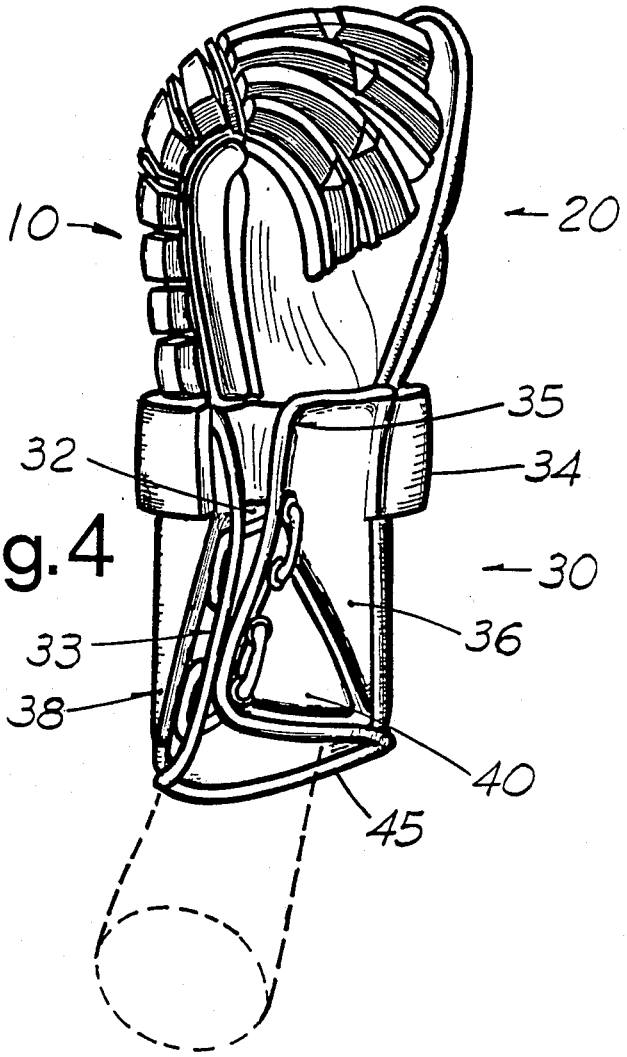
FIGS. 4 and 5 are respectively a side view and a bottom view of the embodiment shown in FIG. 1 with the wrist of the wearer flexed outwardly.
Figure 5:
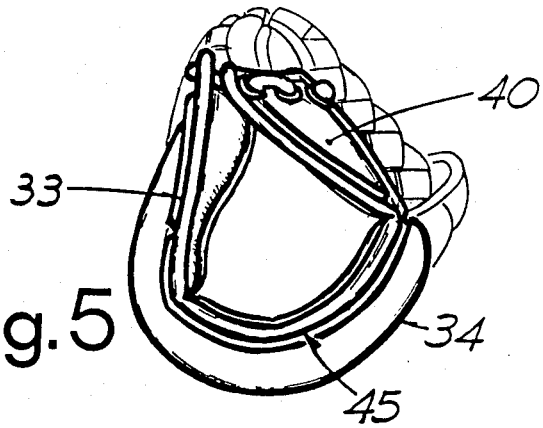
Figure 6:
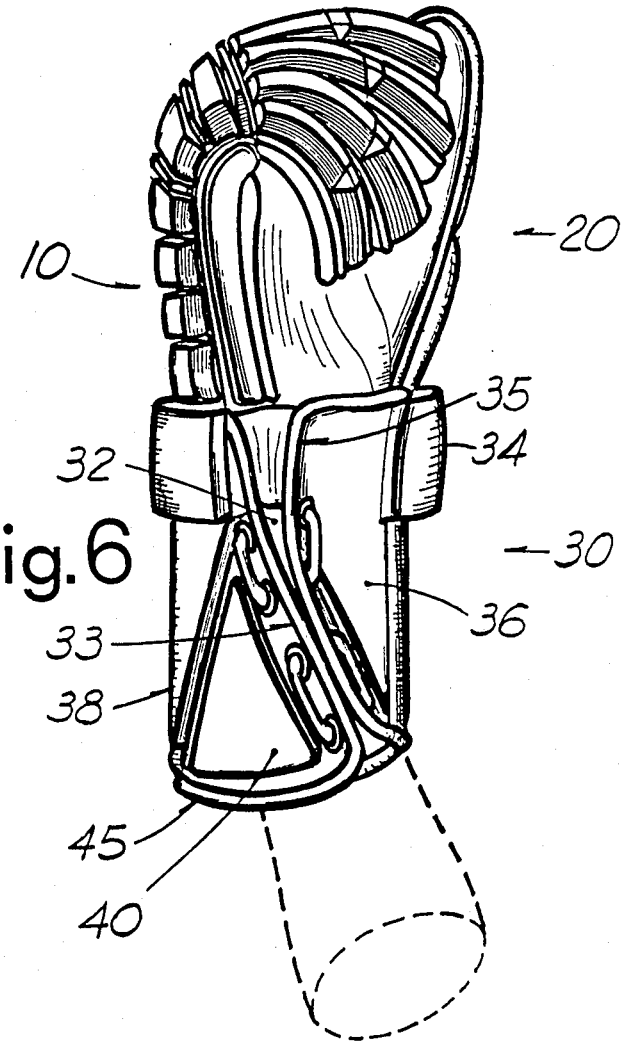
FIGS. 6 and 7 are respectively a side view and a bottom view of the embodiment shown in FIG. 1 with the wrist of the wearer flexed inwardly.
Figure 7:
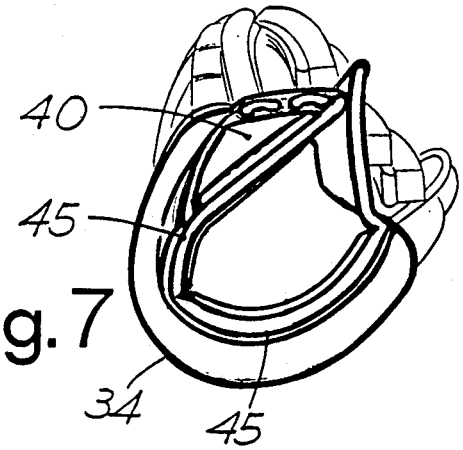

FIGs. 4 and 5 show the operation of the segment in the upper padding 38 as the wrist of the wearer is flexed outwardly while FIGS. 6 and 7 show the operation of the segment in the lower padding 36 as the wrist of the wearer is flexed inwardly.

I claim:

1. An improved hockey glove comprising:

a hand portion including a thumb encasing portion; and a cuff portion having a lower edge and an upper edge spaced apart from each other so as to define a longitudinally extending opening distal from said thumb encasing portion of said hand portion;

wherein said cuff portion comprises a triangular-shaped segment having first, second and third sides, one of said upper and lower edges defining said first side, an end of said cuff portion distal from said hand portion defining said second side, and a hinge defining said third side, said hinge extending from a first point located on the end of said cuff portion at a certain distance from one end of said one of said upper and lower edges toward a second point located on said one of said upper and lower edges.

2. An improved hockey glove as recited in claim 1, comprising a further triangular-shaped segment defined by the other one of said upper and lower edges, by the end of said cuff portion distal from said hand portion, and by a further hinge extending from a first point located on the end of said cuff portion at a given distance from one end of the other of said upper and lower edges toward a second point located on the other one of said upper and lower edges.

3. An improved hockey glove as recited in claim 2, wherein at least one of said hinge and said further hinge comprises a seam in said cuff portion.

4. An improved hockey glove as recited in claim 1, wherein said hinge comprises a seam in said cuff portion.

5. An improved hockey glove as recited in claim 1, wherein said hand portion and said cuff portion have respective adjacent portions which are connected together, said hockey glove comprising padding means overlying said respective adjacent portions of said hand portion and said cuff portion for providing protection thereto.

6. An improved hockey glove as recited in claim 5, wherein said padding means comprises a padding roll extending around said hand portion and said cuff portion from said upper edge to said lower edge.

7. An improved hockey glove as recited in claim 1, wherein said third side is angularly oriented with respect to, and forms a given angle with, a center line which defines a common longitudnal axis of said cuff portion and said hand portion.

8. An improved hockey glove as recited in claim 7, wherein said given angle is relatively small, whereby said improved hockey glove provides relatively more flexibility in movement to the user.

9. An improved hockey glove as recited in claim 7, wherein said given angle is relatively large, whereby said improved hockey glove provides relatively less flexibility in movement to the user.

* * * * *